United States Patent [19]

Ishimoto

[11] Patent Number: 4,596,534

[45] Date of Patent: Jun. 24, 1986

[54] REMOTELY-STEERED TOY CAR WITH FIVE WHEELS

[75] Inventor: Zenichi Ishimoto, Tokyo, Japan

[73] Assignee: Nikko Co., Ltd., Tokyo, Japan

[21] Appl. No.: 580,553

[22] Filed: Feb. 14, 1984

[51] Int. Cl.[4] ..... A63H 30/04; A63H 17/26

[52] U.S. Cl. ..... 446/466; 446/456

[58] Field of Search ..... 446/431, 437, 440, 444, 446/446, 451, 452, 457, 460, 465, 466, 468, 469, 470, 454, 455, 456; 280/705, 695

[56] References Cited

U.S. PATENT DOCUMENTS

| | | | |
|---|---|---|---|
| 368,499 | 8/1887 | Teichmann | 446/457 |
| 2,606,402 | 8/1952 | Fuchs | 446/437 |
| 3,271,899 | 9/1966 | Vaughan | 446/451 |
| 3,574,267 | 4/1971 | Schorsch | 446/431 |
| 3,614,125 | 10/1971 | Sinclair | 280/705 |
| 3,871,129 | 3/1975 | Tong | 446/437 |
| 3,930,550 | 1/1976 | Rose et al. | 280/705 X |
| 3,984,939 | 10/1976 | Wolgamot et al. | 446/437 X |

FOREIGN PATENT DOCUMENTS

| | | | |
|---|---|---|---|
| 8400699 | 3/1984 | World Int. Prop. O. | 446/457 |
| 1048509 | 11/1966 | United Kingdom | 446/446 |
| 2037596 | 7/1980 | United Kingdom | 446/470 |
| 2130902 | 6/1984 | United Kingdom | 446/457 |

*Primary Examiner*—Robert E. Bagwill
*Assistant Examiner*—D. Neal Muir
*Attorney, Agent, or Firm*—Young & Thompson

[57] ABSTRACT

A multiple wheeled toy car featuring a remotely controlled front wheel steering and a single powered, middle, rear wheel for propulsion. Two other rear wheels flank the powered wheel. The flank rear wheels are each mounted upon a freely moveable road wheel arm with a limiter to limit upward travel of the arm. These flank wheels contact the surface and tend to resist lateral displacement of the car's rear end when the car has been placed into a hard turn.

1 Claim, 6 Drawing Figures

REMOTELY-STEERED TOY CAR WITH FIVE WHEELS

A toy car comprising a pair of front wheels and a plurality of rear wheels is disclosed, in which the plurality of rear wheels comprise a central main wheel and a pair of follower wheels on either side of the main wheel. The toy car is simple in construction and may prevent transverse slippage or turnover of a car body upon sudden change of its running direction.

FIELD OF THE INVENTION

This invention relates to a toy car, more particularly to an improvement in the toy car.

BACKGROUND OF THE INVENTION

There have previously been proposed various types of toy cars, such as a spring-drive type, a battery-drive type, a wireless-control type and others, for winning popularity with younger children. However, the majority of such conventional toy cars may slip transversely upon sudden change of a running direction, and in a worse case may lose its balance and turn over. In order to eliminate such disadvantages, an independent-suspension system has been utilized for maintaining the weight balance, which system results in complicated structure and a high cost.

As a result of diligent efforts to design a toy car which is simple in construction and may prevent transverse slippage upon sudden change of the running direction, it has now been found out that an improved design of the toy car comprising a pair of front wheels and a plurality of rear wheels mounted to a car body, in which said plurality of rear wheels comprise a main wheel arranged substantially at the center of a car width and a pair of follower wheels arranged on either sides of the main wheel, said pair of follower wheels each being pivoted to one end of a supporting arm while the other end of the supporting arm being pivoted to an eccentric position in relation to an axle of the main wheel, may run on three wheels, namely the front wheels, the rear main wheel and either one of the follower wheels upon the sudden change of the running direction.

SUMMARY OF THE INVENTION

Thus, an object of the invention is to provide a toy car which is simple in construction and may readily change its running direction.

The object may be achieved, in accordance with the invention by designing the toy car comprising a pair of front wheels and a plurality of rear wheels mounted to a car body, in which said plurality of rear wheels comprise a main wheel arranged substantially at the center of a car width and a pair of follower wheels arranged on either sides of the main wheel, said pair of follower wheels each being pivoted to one end of a supporting arm with the other end of the supporting arm being pivoted to an eccentric position in relation to an axle of the main wheel.

In the toy car of the invention, a running balance may be further improved by putting a heavier fixed loading on the rear wheel side than on the front wheel side of the car body.

The invention will be described in more detail hereinbelow for the preferred embodiment of a wireless-control toy car with reference to the accompanying drawings.

PREFERRED EMBODIMENTS OF THE INVENTION

Figure 1:
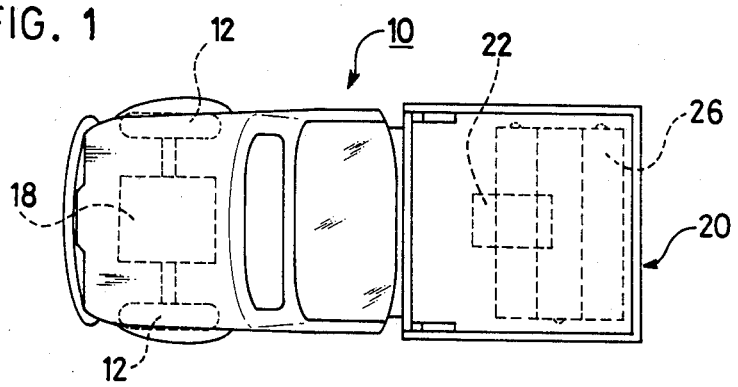
FIG. 1 is a plan view of one embodiment of the toy car according to the invention.

In the drawings, the toy car according to the invention comprises a car body 10 formed of, for example, a plastic material as well as a pair of front wheels 12, 12 and a plurality of rear wheels consisted of a main wheel 14 arranged substantially at the center of a car width and a pair of follower wheels 16, 16 arranged on either side of the main wheel 14. The car body 10 at its front part contains a direction-change means 18 which may be operated by an output signal from a wireless-controller (not shown) provided separately from the car body. The direction-change means 18 may be connected through an optional power-transmission mechanism (not shown) to the front wheels 12, 12. On the other hand, the car body 10 at its rear part, namely at a carrier 20 is provided with a driving motor 22 which is operated by another output signal from the wireless-controller. A driving shaft of the motor 22 is connected through another power-transmission mechanism (not shown) to an axle 24 of the main wheel 14 for serving the main wheel 14 as a driving wheel. In this case, the carrier 20 is provided, in addition to the driving motor 22, with a power battery (not shown) in order to put a heavier fixed loading on the rear wheel side than on the front wheel side.

Figure 2:
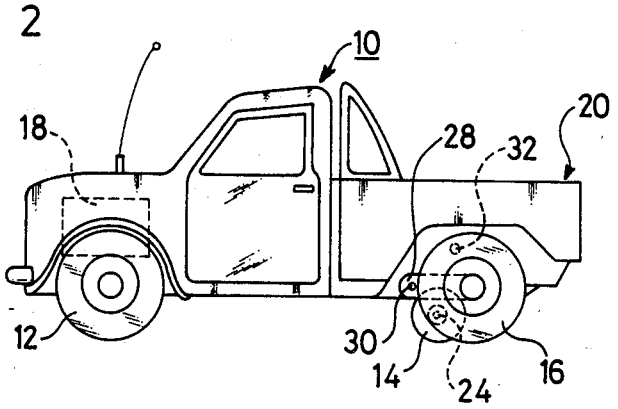
FIG. 2 is a side view of the toy car as shown in FIG. 1.
Figure 3:
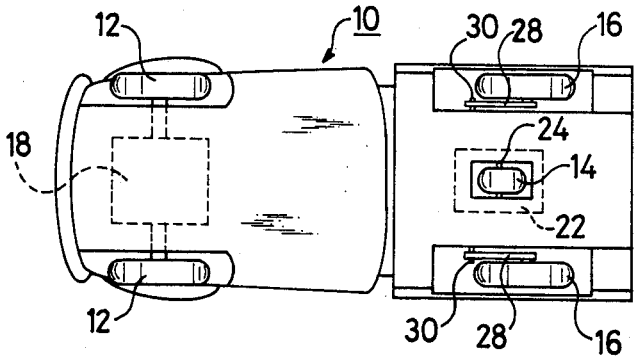
FIG. 3 is a bottom view of the toy car as shown in FIG. 1.

Each of the pair of rear wheels 16, 16 is rotatably mounted to one end of a supporting arm 28, while the other end of the arm 28 is pivoted through a shaft 30 to an eccentric position in relation to an axle 24 of the main wheel 14. In FIG. 2, a reference 32 represents a stopper for defining the upper limit when the supporting arm 28 rotates on the shaft 30.

The toy car according to the invention will be described hereinbelow for its operation and effect.

Figure 4:
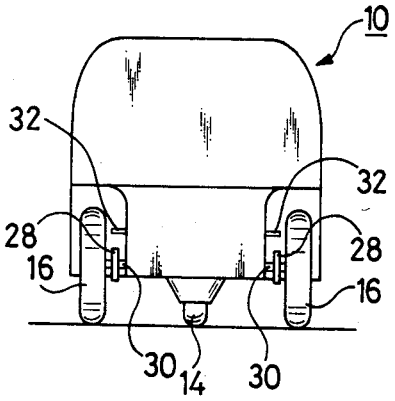
FIG. 4 is a schematic view illustrating the relation between the main and follower wheels and the contacted ground upon straight running of the toy car.
Figure 5:
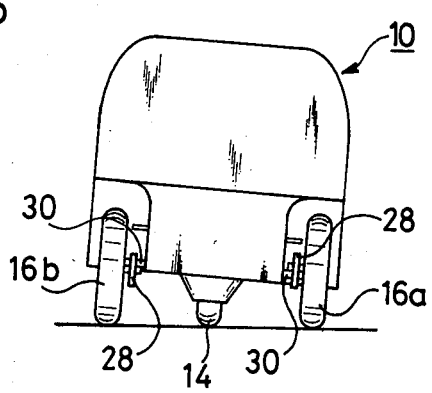
FIG. 5 is a schematic view illustrating the relation between the main and follower wheels and the contacted ground upon changing the running direction.
Figure 6:
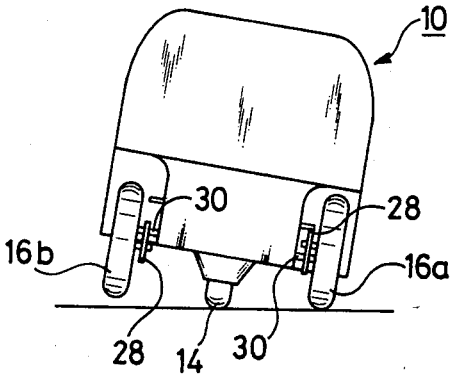
FIG. 6 is a schematic view illustrating a position in which one wheel is lifted off from the ground upon the direction change, as shown in FIG. 5.

In operation of the toy car, the car body 10 is placed on the floor or the ground and the wireless-controller is operated to start rotation of the driving motor 22. Thus, a rotational force of the motor 22 is transmitted through the power-transmission mechanism to the main wheel 14 thereby to drive the toy car straight at a given speed. In this case, both the follower wheels 16, 16 are contacted with the ground due to its own weight applied on the shaft 30 of the supporting arms 28, 28 and may rotate freely (FIG. 4). The toy car may change the running direction for the front wheels 12, 12 through selective operation of the direction-change means 18 by use of the wireless-controller while straight running. In this case, a sudden change of the running direction allows the car body 10 to incline due to a centrifugal force, as shown in FIG. 5. In accordance with the invention, one of the follower wheels 16*b* may rotate downwardly on the shaft 30 of the supporting arm 28 to oppose the centrifugal force in cooperation with the main wheel 14 and the front wheels 12, 12 and thus to prevent loss of the weight balance and transverse slippage or turnover of the car body. The other follower wheel 16*a* may be contacted with the ground, as in the straight running, due to its own weight applied on the shaft 30 of the supporting arm 28 and may rotate freely (FIG. 5). In case of more abrupt change the running direction in relation to the straight running speed, one of the front wheels 12 and one of the follower wheels 16*b* may be lifted off from the ground. However, the remaining front wheel 12, the main wheel 14 and the follower wheel 16*a* may keep running on the three wheels and prevent the transverse slippage or turnover here again (FIG. 6).

As described hereinabove, the toy car according to the invention is simple in construction and may achieve not only the prevention of the transverse slippage and turnover of the car body upon the sudden change of its running direction but also the turning on a small radius. Further, a spin operation upon running is possible, thereby to provide a very amusing toy car.

It will be appreciated that the invention is not limited to the embodiment as described hereinabove and that a front wheel drive system may be employed or a supporting rod for the follower wheels may be resiliently supported through a spring.

Although the invention has been described for its preferred embodiment hereinabove, it will be appreciated that many variations and modifications may be made without departing from the spirit and the scope of the invention.

What is claimed is:

1. A toy car for running on a roadbed without a track or rail, comprising a car body, a pair of front wheels, remotely controlled means for steering said front wheels, and a plurality of rear wheels mounted on said car body, said plurality of rear wheels comprising a main drive wheel arranged substantially at the center of the car width and a pair of rotatable follower wheels arranged on either side of the main wheel, means mounting each of said pair of follower wheels for independent vertical movement responsive to lateral inclination of the car body with respect to the surface of travel, said means mounting said follower wheels for independent vertical movement comprising a separate supporting arm pivotally interconnecting each said follower wheel to the car body such that the axis of the pivot point on the car body is offset from the axis of rotation of the main drive wheel, and stop means mounted on the car body associated with each said follower wheel for limiting the upward pivotal movement of each said arm.

* * * * *